US005507938A

United States Patent [19]

Knight et al.

[11] Patent Number: 5,507,938

[45] Date of Patent: Apr. 16, 1996

[54] FLASH THERMOCRACKING OF TAR OR PITCH

[75] Inventors: Richard A. Knight, Brookfield; Ronald H. Carty, Chicago; Michael Onischak, Olympia Fields, all of Ill.

[73] Assignee: Institute of Gas Technology, DesPlaines, Ill.

[21] Appl. No.: 279,345

[22] Filed: Jul. 22, 1994

[51] Int. Cl.[6] ..... C10C 1/19; C10C 3/04

[52] U.S. Cl. ..... 208/39; 208/40; 208/42; 208/43

[58] Field of Search ..... 208/39, 44, 42, 208/43

[56] References Cited

U.S. PATENT DOCUMENTS

| | | | |
|---|---|---|---|
| 3,928,170 | 12/1975 | Takahashi et al. | 208/40 |
| 4,127,473 | 11/1978 | Hozuma et al. | 208/130 |
| 4,554,148 | 11/1985 | Gomi et al. | 208/40 |
| 4,758,329 | 7/1988 | Newman et al. | 208/131 |
| 4,999,099 | 3/1991 | Fu et al. | 208/39 |
| 5,091,072 | 2/1992 | Tsuchitani et al. | 208/39 |
| 5,198,101 | 3/1993 | Kalback | 208/39 |

OTHER PUBLICATIONS

Berber, J. S. et al., "Low–Temperature Lignite Tar: Processing and Utilization", Bulletin 663, United States Department of the Interior, Bureau of Mines, 1973.

Stadelhofer, J. W. et al., "The Manufacture of High–Value Carbon from Coal–Tar Pitch", *Fuel,* 60:9, 877–882 (1981).

*Primary Examiner*—Helane Myers

*Attorney, Agent, or Firm*—Speckman, Pauley & Fejer

[57] ABSTRACT

A process for producing high-quality pitches comprising atomizing a preheated feed material of carbonaceous tar and/or pitch, forming an aerosol, contacting the aerosol in a reaction vessel with a flowing, non-reactive gas atmosphere for less than about 10 seconds at a gas temperature of about 1400° F. to about 2000° F., and separating and recovering a liquid fraction of the liquid formed in the reaction vessel which remains in a liquid phase up to a distillation temperature of about 750° F.

8 Claims, No Drawings

FLASH THERMOCRACKING OF TAR OR PITCH

BACKGROUND OF THE INVENTION

1. Field of the Invention

This invention relates to a process for producing "high-quality" carbonaceous pitch suitable for use in a variety of chemical and physical situations such as in the production of carbon electrodes for aluminum electrolysis cells, steel arc furnaces, or other electrochemical processes, or as an industrial binder for use in roofing, road construction materials and similar applications. Some available sources of tar or pitch, for example mild coal gasification processes or sub-standard coke oven tars, do not produce pitch having the specifications required by such applications. The process of this invention not only produces pitch suitable for use in such applications, converting low-quality pitches to high-quality pitches, but also increases the pitch yield over known processes without sacrificing pitch quality. In particular, low-quality pitches are improved by flash thermocracking, yielding 25 to 26 wt % high-quality pitch compared to the process of this invention by which pitch yield is increased to about 28 to 40 wt % without sacrificing quality.

2. Description of Prior Art

Flash thermocracking of low-temperature coal tars to produce a binder pitch is known, having been studied by the U.S. Bureau of Mines in the period 1963-1973. See Berber, J. S. et al, "Low-Temperature Lignite Tar: Processing and Utilization" Bulletin 663 United States Department of the Interior, Bureau of Mines, 1973. U.S. Pat. No. 5,091,072 teaches a continuous process for preparing high softening point pitches comprising heat treating a heavy oil or pitch by dispersing the heavy oil or pitch in a gas stream of an inert gas or superheated vapor, as fine oil droplets, and bringing the dispersed fine oil droplets into contact with the inert gas or superheated vapor, at a temperature of 350° to 550° C. under a reduced or normal pressure. In accordance with the teachings of the '072 patent, the temperature range of 350° to 550° C. is indicated to be critical because, if the temperature is not high enough, removal of the light fractions is insufficient whereas, if the temperature is too high, excessive thermal polymerization such as coking tends to take place, even though the time required for the treatment is short. Dispersion of the preheated heavy oil or pitch in accordance with the teachings of the '072 patent are carried out by application of a centrifugal force to the preheated heavy oil or pitch by a rotating structure such as a disk, a cone or a bowl rotating at a rate so as to introduce the droplets so formed into the gas streams substantially perpendicular to the direction of the gas flow. The pitch produced in accordance with the process disclosed by the '072 patent has quinoline insolubles (QI) of less than 1 wt %.

U.S. Pat. No. 3,928,170 teaches a process for manufacturing a highly aromatic pitch by heat treating an aliphatic hydrocarbon-containing petroleum-based residual oil for efficient cracking, poly-condensing and aromatizing thereof. The heat treatment is conducted in such a manner that the raw material oil is brought into direct contact with a non-oxidizing gas or a perfectly combusted gas containing substantially no oxygen, as a heat carrier gas, heated to 400° to 2000° C. To effect thermocracking, aromatization and poly-condensation, the temperature of the raw material oil is maintained within the range of 350° to 450° C. Contact of the raw material oil with the heat carrier gas is achieved by blowing the heat carrier gas into the raw material oil or, alternatively, employing a jet scrubber. The residence time of the raw material oil within the reactor through which the heat carrier gas is blown is in the range of 0.5 minutes up to 20 hours, depending on the preheat temperature of the raw material oil.

Thermocracking of a raw material oil to produce pitch is taught by U.S. Pat. No. 4,554,148 in which the raw material oil is subjected to thermocracking conditions at a temperature between 400° to 500° C. while removing cracked, light hydrocarbon components to obtain a pitch product containing mesophase and light hydrocarbon components. U.S. Pat. No. 4,127,473 teaches a method for the batch thermocracking of heavy oils, such as steam blowing for production of binder pitch, employing a reactor having a rotary injection pipe which is rotatable within the reactor. Upon completion of the thermocracking and withdrawal of the reaction product, the injection pipe, while in rotation, ejects preheated raw material under pressure against the interior wall surfaces of the reactor to remove coke which is deposited on the reactor walls during the previous cracking operation.

U.S. Pat. No. 5,198,101 teaches a process for producing an anisotropic pitch in which a metal alkylaryl sulfonate is combined with a carbonaceous feedstock substantially free of mesophase pitch and heated for a period of time at an elevated temperature while passing a non-oxidative sparging gas such as nitrogen through the feedstock. Similarly, U.S. Pat. No. 4,999,099 teaches a process for producing an anisotropic pitch in which a carbonaceous feedstock alone is heated at elevated temperature while passing a reactant sparging gas therethrough. U.S. Pat. No. 4,758,329 teaches a coking process in which the coke co-efficient of thermal expansion (CTE) is reduced and coke particle size is increased by sparging with a gas during the coking cycle.

See also Stadelhofer, J. W. et al, "The Manufacture of High-Value Carbon from Coal-Tar Pitch", Fuel., 60:9, 877–882 (1981) which teaches delayed coking and horizontal chamber coking for the production of cokes with low sulfur and metal content and the manufacture of hard pitch by means of a continuous flash process with optimized thermal and pressure treatment of pitch to facilitate the "tailored" manufacture of binder pitches of different qualities.

It is an object of this invention to provide a process for producing high-quality pitches suitable for use as binders for carbon electrodes or other graphitized articles, or as a binder for roads, roofs, and other industrial and commercial markets.

It is another object of this invention to provide a process for producing high-quality pitches from low-quality pitches whereby the yield of pitch is increased without sacrificing pitch quality.

These and other objects of this invention are achieved by a process for producing high-quality pitches in which preheated coal tar and/or preheated low quality pitch s atomized, forming an aerosol. The aerosol is injected into a reaction vessel in which it is contacted with a flowing, non-reactive gas atmosphere for less than about 10 seconds. The temperature of the gas atmosphere is in the range of about 1400° F. to about 2000° F. A range of gaseous, liquid and solid products are formed in the reaction vessel. The fraction of the liquid product that fails to distill at temperatures below about 750° F. is separated from the distilled product and recovered as product pitch. This combination of flash thermocracking and atomization of the preheated feed to the reaction vessel results in higher yields of product pitch and lower yields of product coke than flash thermocracking without atomization.

DESCRIPTION OF PREFERRED EMBODIMENTS

The process of this invention produces "high-quality" coal tar or pitch suitable for use in a variety of chemical and physical situations such as in the production of carbon electrodes for aluminum electrolysis cells, steel arc furnaces, or other electrolytic processes, or as an industrial binder for use in roofing and road construction materials. The properties of pitch suitable for use in the aforementioned applications include quinoline insolubles (QI) in the range of 8 to 12 wt %, toluene insolubles (TI) in the range of about 26 to 32 wt % softening point (Ring & Ball) in the range of about 190° to 250° F. coking value in the range of about 50 to 60 wt %, and specific gravity greater than about 1.25. Accordingly, the conditions of the process by which the desired tars are produced are critical to obtaining the desired end product.

Accordingly, in accordance with one embodiment of the process of this invention, feed material in the form of liquid coal-derived tar and/or pitch is preheated to a temperature suitable for atomization, typically between about 175° F. and about 300° F., depending on the specific theological properties of the raw material, and subsequently injected through an atomizing means into a reaction vessel. The preheat temperature is selected to obtain a range of liquid viscosities that produce suitable atomization behavior. The atomizing means is of the type that produces droplets having a Sauter mean diameter of about 100 microns or less. Atomizing means suitable for this purpose are well known to those skilled in the art. The purpose of atomization of the hot pitch and/or tar to produce an aerosol is to provide small droplets which are able to survive in the liquid phase for a longer time before either coalescing with other pitch droplets or impacting against the hot reactor walls than is achievable without atomization. This, in turn, allows a more uniform and rapid heating of the pitch droplets to produce the poly-condensed structures required for binder properties. Without atomization, the momentum of the larger particles results in more frequent droplet collisions with each other and with the hot walls of the reactor, resulting in more coke formation. In addition, the size of the droplets produced in the atomization step, that is, 100 microns or less, is critical to preventing the production of excessive mesophase pitch with spherule diameters exceeding 2 microns.

The preheated feed material in the form of an aerosol is exposed in the reaction vessel to a flowing non-reactive gas atmosphere at a temperature of about 1400° to about 2000° F for less than 10 seconds, preferably for less than 5 seconds. A range of gaseous, liquid, and solid products is obtained. From the liquid products obtained in the reaction vessel, the fraction which remains in the liquid phase upon distillation to about 750° F., which liquid fraction is the product pitch, is separated and recovered.

In addition to aerosol droplet size, the critical factors for producing a pitch having the desired properties are temperature of the non-reactive gas atmosphere and residence time of the aerosol droplets within the flowing gas stream. For example, we have found that at a non-reactive gas atmosphere temperature of about 1500° F., contacting of the aerosol with the non-reactive gas atmosphere for about 3.5 seconds is sufficient to obtain the desired product pitch. At lower temperatures, however, thermocracking at such a residence time does not result in sufficient dealkylation and aromatization of the pitch. At temperatures below about 1400° F., the thermal cracking rates are too slow, with the result that residence times sufficient to increase the aromaticity, coking value, and viscosity produce substantial amounts of mesophase pitch. The properties of mesophase pitch are such that an excessive amount of mesophase pitch renders the product unsuitable for use in applications for which the pitch produced in accordance with the process of this invention is used. In general, the combination of non-reactive gas temperature and residence time of the aerosol droplets within the non-reactive gas atmosphere should be selected from a range which produces about 8 to 12 wt % non-mesophase QI and about 26 to 32 wt % TI (toluene-insolubles).

As previously stated, the preheated aerosol droplets are injected into a flowing non-reactive gas atmosphere. By non-reactive gas atmosphere, we mean a gas atmosphere which is not reactive with the components of the feed materials at the treatment temperature. Suitable non-reactive gases for use in the process of this invention comprise nitrogen, helium, argon, or any other gas which does not react significantly with the feedstock.

Low-quality pitches can be improved by flash thermocracking, yielding 25 to 26 wt % high-quality pitch. However, by atomizing the feedstock at the reactor inlet in accordance with the process of this invention, the pitch yield can be increased to 28 to 40 wt % without sacrificing quality.

Flash thermocracking of liquids from low temperature pyrolysis of Illinois NO. 6 coal produced a range of gaseous, liquid, and solid products. The fraction of the liquid product that remains undistilled at a temperature of about 750° F. was found to possess rheological and carbonization properties suitable for an electrode binder for electrolytic aluminum production. The combination of flash thermocracking with atomization of the liquid at the reactor inlet resulted in high yields of product pitch and lower yields of product coke than flash thermocracking without atomization.

TABLE 1

| Sample | Unmodified Coal Pyrolysis Pitch | PC-0302-111 | PC-0402-110 | PC-0427-510 | PC-0513-511 |
|---|---|---|---|---|---|
| Test Temperature F° | — | 1500 | 1500 | 1400 | 1400 |
| Pitch Rate, g/min | — | 8.7 | 11.1 | 12.7 | 9.2 |
| Atomization | — | Yes | No | No | Yes |
| YIELDS | | | | | |
| Cracked Pitch | — | 27.5 | 26.1 | 25.5 | 40.1 |
| Pitch Coke | — | 30.1 | 36.4 | 44.2 | 25.7 |
| Distillate Oils | — | 17.5 | 15.7 | 16.6 | 18.9 |
| Gas | — | 23.3 | 19.8 | 12.0 | 14.1 |
| Water | — | 1.7 | 2.0 | 1.7 | 1.3 |
| PITCH PROPERTIES | | | | | |

TABLE 1-continued

| Sample | Unmodified Coal Pyrolysis Pitch | PC-0302-111 | PC-0402-110 | PC-0427-510 | PC-0513-511 |
|---|---|---|---|---|---|
| QI, wt % | 0.01 | 13.6 | 15.7 | 10.2 | 12.0 |
| TI, wt % | 7.0 | 26.9 | 28.5 | 25.9 | 32.8 |
| Softening Point (Ring & Ball), F° | 104 | 195 | 187 | 206 | 236 |
| Coking Valve, wt % | 24.0 | 49.7 | 49.9 | 46.4 | 50.3 |
| Specific Gravity | 1.16 | 1.21 | 1.26 | 1.22 | 1.16 |

Table 1 shows the yield structure of thermocracking products obtained at 1400° F. and 1500° F. with and without atomization. Cracked pitch is defined as the liquid product that remains undistilled at 750° F., including fine dispersed solids (QI) which pass through a 100-mesh screen. Pitch coke is defined as the solid product that collects on the reactor walls, that will not dissolve in tetrahydrofuran, and that will not pass through a 100-mesh screen when the pitch/coke mixture is subjected to a gravity filtration using such a screen at a temperature near the softening point of the product pitch. As shown in Table 1, at 1400° F., the pitch yield increased from 25.5 to 40.1 wt % and the coke yield decreased from 44.2 to 25.7 wt % when atomization was used. At 1500° F., the increase in cracked pitch yield was smaller, from 26.1 to 27.5 wt %, while the decrease in pitch coke yield was from 36.4 to 30.1 wt %. The quality criteria (QI, TI, softening point, coking value and density) of the cracked pitches, as shown in Table 1, did not change significantly with or without of atomization.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for producing high quality pitches comprising:

atomizing at least one of a preheated carbonaceous tar and a preheated carbonaceous pitch, forming an aerosol;

contacting said aerosol in a reaction vessel with a flowing, non-reactive gas atmosphere for less than about ten seconds at a gas temperature of about 1400° F. to about 2000° F., forming a liquid; and recovering and separating a liquid fraction of said liquid which remains in a liquid phase up to a distillation temperature of about 750° F., said liquid fraction comprising at least one high quality pitch.

2. A process in accordance with claim 1, wherein said aerosol comprises droplets having a mean Sauter diameter of less than about 100 microns.

3. A process in accordance with claim 1, wherein said gas atmosphere comprises a non-reactive gas selected from the group consisting of nitrogen, argon, helium, carbon oxides and mixtures thereof.

4. A process in accordance with claim 1, wherein the temperature of said at least one of said preheated carbonaceous tar and said preheated carbonaceous pitch is the range of about 175° F. to about 300° F.

5. A process for producing a high quality pitch having a non-mesophase QI content in the range of about 8 to 12 wt %, a TI in the range of about 26 to 32 wt %, a softening point in the range of about 190° to 250° F. (Ring & Ball), a coking value in the range of about 50 to 60 wt %, and a specific gravity greater than about 1.25, comprising:

atomizing at least one of a preheated carbonaceous tar and a preheated carbonaceous pitch, forming an aerosol;

contacting said aerosol in a reaction vessel with a flowing, non-reactive gas atmosphere for less than about ten seconds at a gas temperature of about 1400° F. to about 2000° F., forming a liquid; and recovering and separating a liquid fraction of said liquid which remains in a liquid phase up to a distillation temperature of about 750° F., said liquid fraction comprising said high quality pitch.

6. A process in accordance with claim 5, wherein said aerosol comprises droplets having a mean Sauter diameter of less than about 100 microns.

7. A process in accordance with claim 5, wherein said gas atmosphere comprises a non-reactive gas selected from the group consisting of nitrogen, argon, helium, carbon oxides and mixtures thereof.

8. A process in accordance with claim 5, wherein the temperature of said at least one of said preheated carbonaceous tar and said preheated carbonaceous pitch is in the range of about 175° F. to about 300° F.

* * * * *